US008599086B2

(12) United States Patent
Wong et al.

(10) Patent No.: US 8,599,086 B2
(45) Date of Patent: Dec. 3, 2013

(54) MONOPOLE SLOT ANTENNA

(75) Inventors: Kin-Lu Wong, Taipei Hsien (TW); Fang-Hsien Chu, Taipei Hsien (TW)

(73) Assignee: Acer Incorporated, New Taipei (TW)

( * ) Notice: Subject to any disclaimer, the term of this patent is extended or adjusted under 35 U.S.C. 154(b) by 398 days.

(21) Appl. No.: 12/536,584

(22) Filed: Aug. 6, 2009

(65) Prior Publication Data

US 2010/0245176 A1 Sep. 30, 2010

(30) Foreign Application Priority Data

Mar. 27, 2009 (TW) ..... 98110256 A

(51) Int. Cl.
*H01Q 13/10* (2006.01)
*H01Q 1/00* (2006.01)
*H01Q 1/24* (2006.01)

(52) U.S. Cl.
USPC ..... 343/767; 343/702; 343/729

(58) Field of Classification Search
USPC ..... 343/700 MS, 702, 846, 729, 767–771; 455/575.1, 575.7
See application file for complete search history.

(56) References Cited

U.S. PATENT DOCUMENTS

| | | | | |
|---|---|---|---|---|
| 5,835,063 | A | 11/1998 | Brachat et al. | |
| 6,133,879 | A * | 10/2000 | Grangeat et al. | 343/700 MS |
| 6,762,723 | B2 * | 7/2004 | Nallo et al. | 343/700 MS |
| 6,822,611 | B1 * | 11/2004 | Kontogeorgakis et al. | 343/702 |
| 7,042,404 | B2 * | 5/2006 | Jo et al. | 343/702 |
| 7,053,848 | B2 * | 5/2006 | Shoji et al. | 343/770 |
| 7,184,808 | B2 * | 2/2007 | Shoji | 455/575.7 |
| 7,209,087 | B2 | 4/2007 | Tang et al. | |
| 7,417,593 | B1 * | 8/2008 | Hsiao et al. | 343/702 |
| 7,471,249 | B2 | 12/2008 | Tang et al. | |
| 7,630,743 | B2 * | 12/2009 | Uejima et al. | 455/575.3 |
| 2008/0272971 | A1 * | 11/2008 | Kanno | 343/767 |

FOREIGN PATENT DOCUMENTS

| | | |
|---|---|---|
| CN | 101102009 A | 1/2008 |
| TW | I258891 B | 7/2006 |

OTHER PUBLICATIONS

Office Action of corresponding CN application, issued on Jun. 26, 2012.
Office Action of its corresponding TW patent application issued on Nov. 2, 2012.

* cited by examiner

*Primary Examiner* — Michael C Wimer
*Assistant Examiner* — Hasan Islam
(74) *Attorney, Agent, or Firm* — Wang Law Firm, Inc.; Li K. Wang; Stephen Hsu

(57) ABSTRACT

A monopole slot antenna applicable to a mobile communication device includes a dielectric substrate, a first ground plane, a second ground plane, a monopole slot, and a microstrip feedline. The first ground plane is disposed on the dielectric substrate. The second ground plane is in the vicinity of the first ground plane and electrically connected to the first ground plane via a metal wire. A section of the metal wire is disposed on one surface of the dielectric substrate. The monopole slot is disposed on the first ground plane and has an open end disposed near the metal wire that connects the first and the second ground planes. The microstrip feedline is disposed on a surface of the dielectric substrate opposite to the first ground plane with one end of the microstrip feedline extended across the monopole slot and the other end connected to a signal source.

14 Claims, 5 Drawing Sheets

MONOPOLE SLOT ANTENNA

FIELD OF THE INVENTION

The present invention relates to an antenna for mobile communication devices, and more particularly to a monopole slot antenna applicable to mobile communication devices, such as a folder-type mobile phone or a mobile communication device with an upper cover.

BACKGROUND OF THE INVENTION

Due to the quick development in mobile communication technology in recent years, light weight, low profile and compactness have become the most important factors in designing current mobile communication devices. Accordingly, the antenna for compact mobile communication devices must also satisfy the requirements of small size, planar structure, and multiband operation. Both U.S. Pat. No. 7,209,087 B2 entitled "Mobile Phone Antenna" and U.S. Pat. No. 7,471,249 B2 entitled "EMC Metal-Plate Antenna and a Communication System Using the Same" disclose a mobile phone antenna that occupies a three-dimensional space. However, the antenna with three-dimensional design usually shows a big volume and still may not fully cover the requirements for five-band wireless wide area network (WWAN) operation of GSM850/900/1800/1900/UMTS.

In this invention, this problem is solved by developing a monopole slot antenna particularly suitable for use in a folder-type mobile communication device or a mobile communication device having an upper cover. The monopole slot antenna according to the present invention is a planar design to occupy only a small area less than 10×40 $mm^2$, and has a simple structure that can be easily printed or etched on the system circuit board of the mobile communication device at low cost; in addition, the monopole slot antenna of the present invention is capable of five-band WWAN operation in the GSM850 (824~894 MHz), GSM900 (880~960 MHz), GSM1800 (1710~1880 MHz), GSM1900 (1850~1990 MHz), and UMTS (1920~2170 MHz) bands.

SUMMARY OF THE INVENTION

A primary object of the present invention is to provide a monopole slot antenna that has a very small size and is suitable for application in a folder-type mobile phone or a mobile communication device with an upper cover for five-band WWAN operation.

To achieve the above and other objects, the monopole slot antenna according to the present invention includes a dielectric substrate, a first ground plane, a second ground plane, a monopole slot having an open end, and a microstrip feedline. The dielectric substrate can be a system circuit board of a mobile communication device. The first ground plane is disposed on the dielectric substrate through printing or etching process, and can be a system ground plane for the mobile communication device. The second ground plane can be a backing metal plate for an upper cover of a folder-type mobile communication device, and is disposed in the vicinity of and electrically connected to the first ground plane via a metal wire, which has a section disposed on a surface of the dielectric substrate. The monopole slot is disposed on the first ground plane, and can be formed oil the dielectric substrate through printing or etching process; the open end of the monopole slot is disposed near the metal wire connecting the first and the second ground planes; and the monopole slot includes at least one bending to reduce the size of the antenna.

The microstrip feedline is disposed on a surface of the dielectric substrate opposite to the first ground plane, and can be formed on the dielectric substrate through printing or etching process; and the microstrip feedline has an end extended across the monopole slot and the other end connected to a signal source.

With the monopole slot antenna of the present invention, the monopole slot itself can contribute a first (lowest) resonant mode having about one-quarter wavelength at about 900 MHz, and a fourth resonant mode in the present invention at about 2000 MHz. Meanwhile, the strong electric field at the open end of the monopole slot can excite the dipole-like resonant modes contributed by the first and the second ground planes, so as to form a second resonant mode in the present invention at about 1000 MHz and a third resonant mode in the present invention at about 1700 MHz. Meanwhile, by adjusting the length of the section of the metal wire disposed on the dielectric substrate, it is very effective to adjust the second and the third resonant modes to achieve good impedance matching. From the four excited resonant modes, the antenna's lower band formed by the first and second resonant modes in the present invention can cover the GSM850/900 operation, and the antenna's upper band formed by the third and fourth resonant modes in the present invention can cover the GSM1800/1900/UMTS operation. Therefore, a five-band operation can be achieved with the monopole slot antenna of the present invention.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
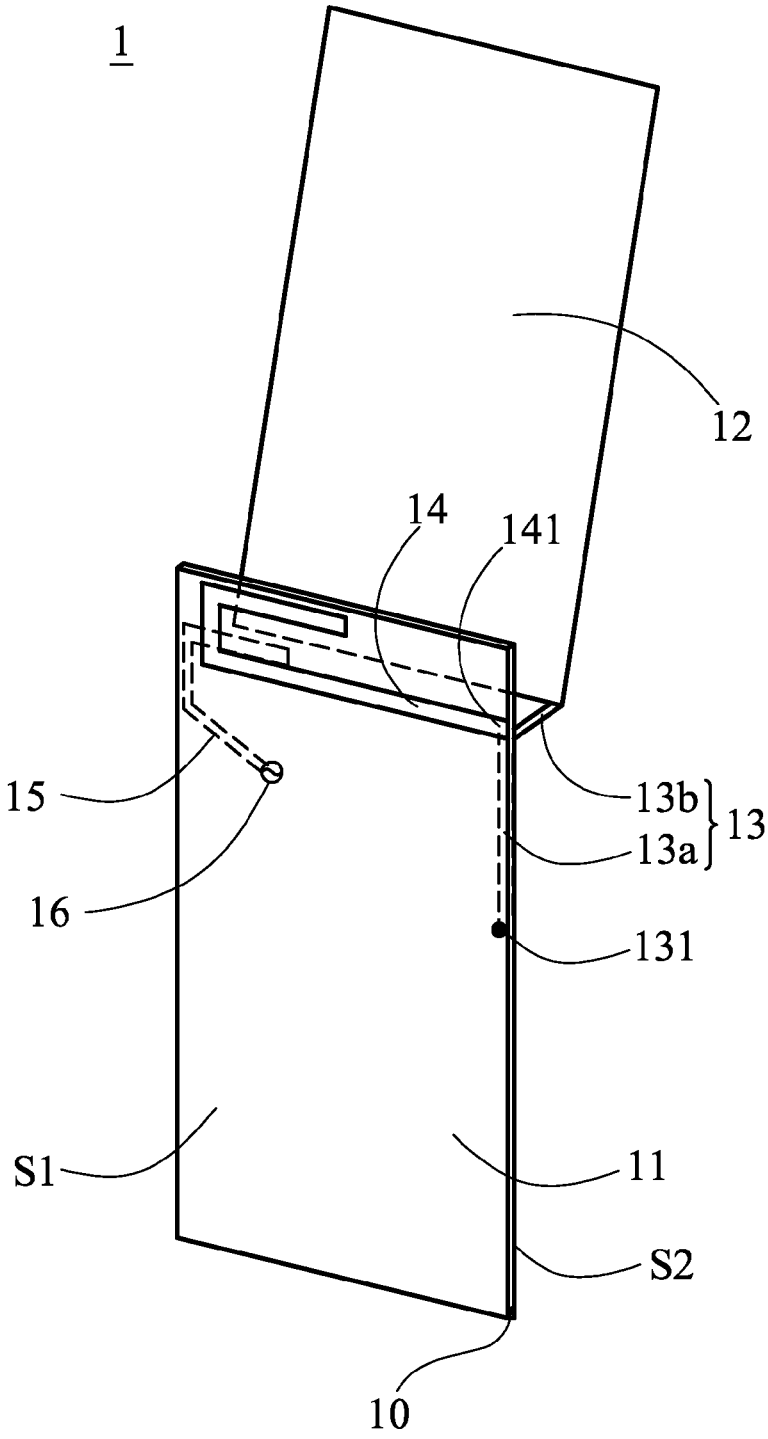
FIG. 1 is a perspective view showing the structure of a monopole slot antenna according to a first embodiment of the present invention.
Figure 2:
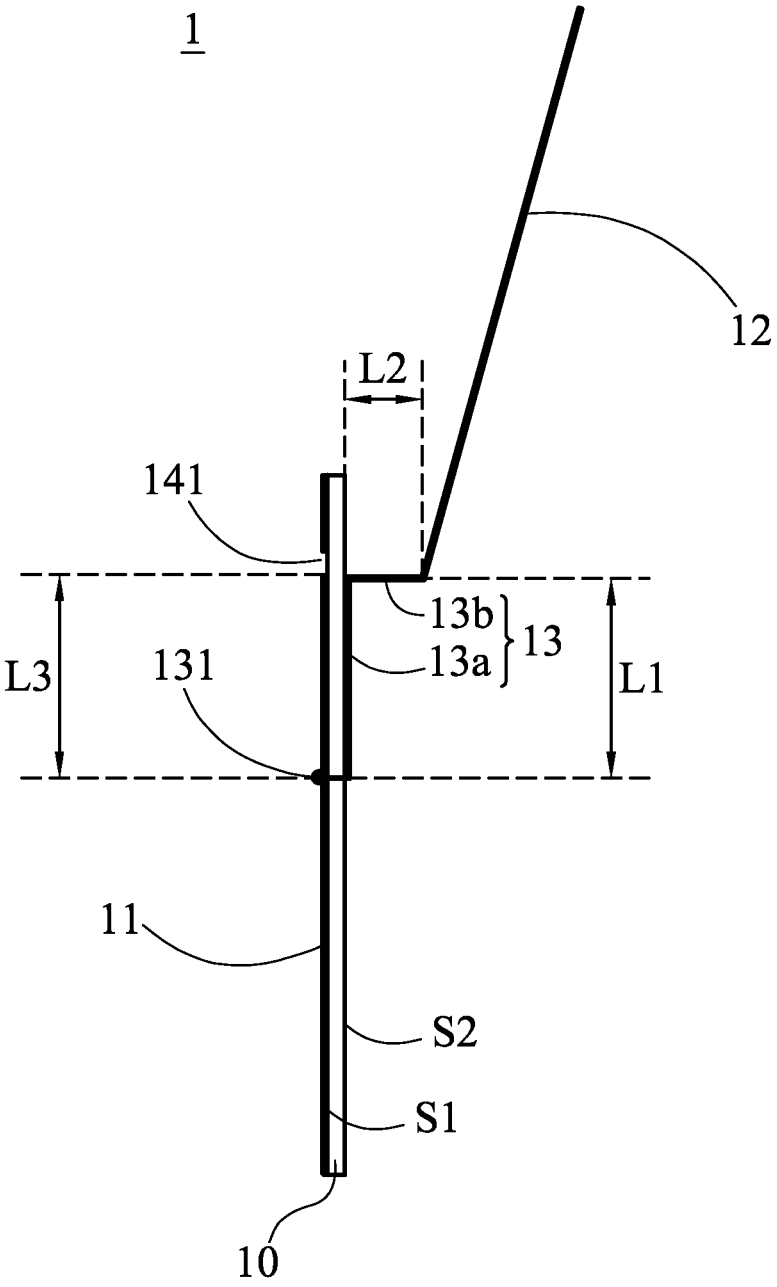
FIG. 2 is a side view of FIG. 1.

Please refer to FIGS. 1 and 2 that are perspective and side views, respectively, showing the structure of a monopole slot antenna 1 according to a first embodiment of the present invention. As shown, the antenna 1 includes a dielectric substrate 10; a first ground plane 11 disposed on a first surface S1 of the dielectric substrate 10; a second ground plane 12 in the vicinity of and electrically connected to the first ground plane 11 via a metal wire 13, a section 13*a* of which is disposed on a second surface S2 of the dielectric substrate 10 opposite to the first surface S1 and then short-circuited to the first ground plane 11 via an electric contact 131; a monopole slot 14 provided on the first ground plane 11 and having an open end 141 disposed near the metal wire 13 that electrically connects the first ground plane 11 to the second ground plane 12; and a microstrip feedline 15 disposed on a surface of the dielectric substrate 10 opposite to the first ground plane 11 with an end extended across the monopole slot 14 and the other end connected to a signal source 16.

Figure 3:
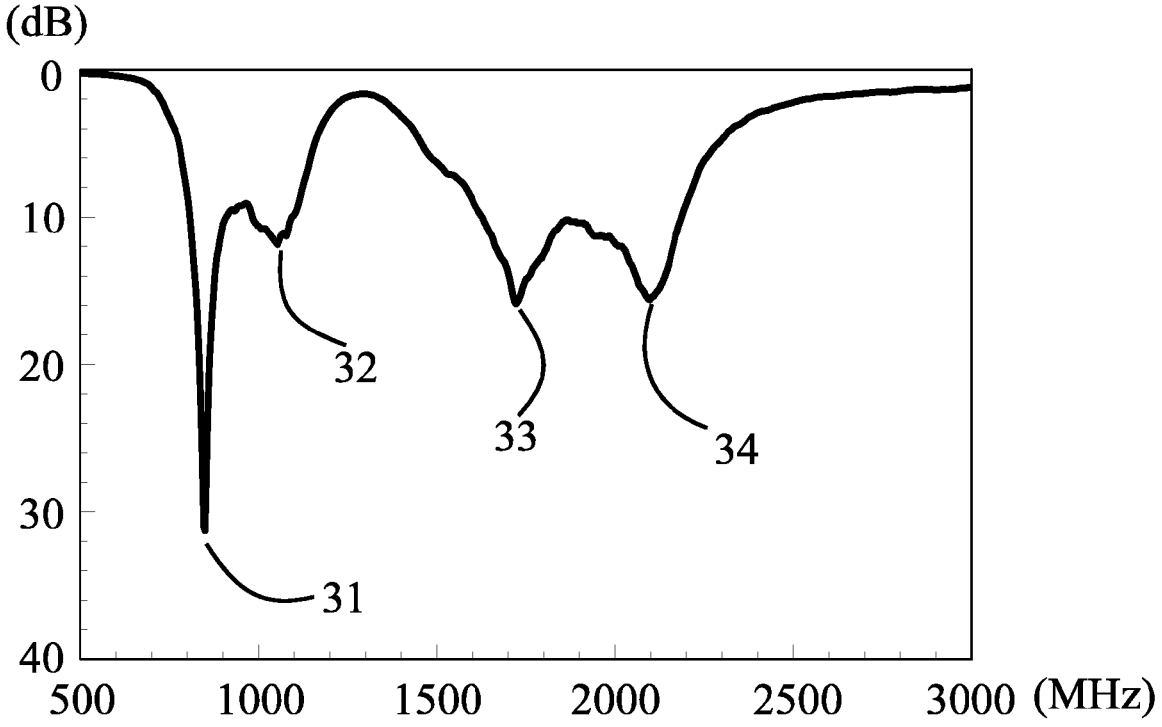
FIG. 3 is a diagram showing the measured return loss of the monopole slot antenna according to the first embodiment of the present invention.

FIG. 3 is a diagram showing the measured return loss measurements of the monopole slot antenna 1 according to the first embodiment of the present invention. In the first embodiment, the dielectric substrate 10 is a fiberglass dielectric substrate having a width about 40 mm, a length about 95 mm and a thickness about 0.8 mm, and is used as the system circuit board of an mobile communication device; the first ground plane 11 or the monopole slot 14, or the microstrip feedline 15 is formed on the dielectric substrate 10 through printing or etching process; the first ground plane 11 is the system ground plane of a mobile communication device with the monopole slot 14 formed thereon within an upper portion of the dielectric substrate 10 having an area about 10 ×40 $mm^2$; the monopole slot 14 has at least one bending and a total length about 60 mm and a width about 2 mm, and is able to excite in the antenna's lower band a first (lowest) resonant mode 31 having about one-quarter resonant wavelength at 900 MHz, and in the antenna's upper band a fourth resonant mode 34; the second ground plane 12 is a metal plate having a width about 40 mm and a length about 85 mm for use as a backing metal plate for an upper cover of a mobile communication device; the section 13*a* of the metal wire 13 being disposed on the dielectric substrate 10 has a length about 36 mm, and another section 13*b* of the metal wire 13 being perpendicularly extended from the dielectric substrate 10 has a length about 10 mm, wherein the length L1 of the section 13*a* is at least one half of the length (L1+L2)of the metal wire 13 (i.e. L1≥(L1≥L2)/2). As shown in FIG. 2, the section 13*a* of the metal wire 13 is short-circuited to the first ground plane 11 at the electric contact 131, and the distance L3 between the electric contact 131 and the open end 141 of the monopole slot 14 is substantially equal to the length L1 of the section 13*a* (i.e. L3=L1). Thus, the electric contact 131 has a distance at least one half of the length (L1=L1) of the metal wire 13 to the open end 141 of the monopole slot 14 (i.e. L3≥(L1+L2)/2). The first and the second ground planes 11, 12 together contribute dipole-like resonant modes, which can excite in the antenna's lower band a second resonant mode 32, and in the antenna's upper band a third resonant mode 33. According to the results from the experiment, with the definition of 6-dB return loss, the first resonant mode 31 and the second resonant mode 32 are sufficient to cover the GSM850 (824~894 MHz) and GSM900 (880~960 MHz) operation, and the third resonant mode 33 and the fourth resonant mode 34 are sufficient to cover the GSM1800 (1710~1880 MHz), GSM1900 (1850~1990 MHz) and UMTS (1920~2170 MHz) operation.

Figure 4:
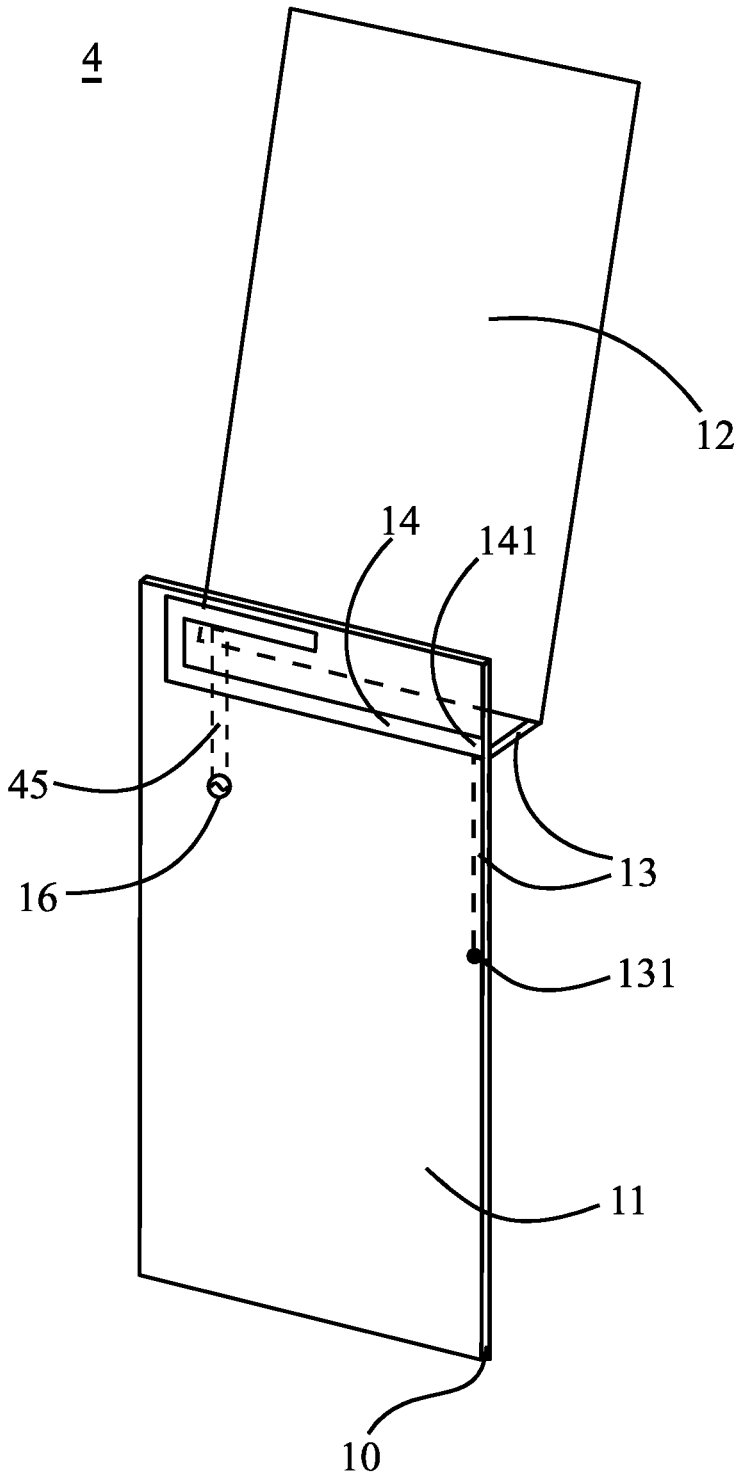
FIG. 4 is a perspective view showing the structure of a monopole slot antenna according to a second embodiment of the present invention.

FIG. 4 is a perspective view showing the structure of a monopole slot antenna 4 according to a second embodiment of tie present invention. The structure of the second embodiment is in general similar to that of the first embodiment, except for a microstrip feedline 45 that is substantially straight in forum. With the straight microstrip feedline 45, the monopole slot antenna 4 in the second embodiment can also achieve the same characteristics of multiband operation as the first embodiment.

Figure 5:
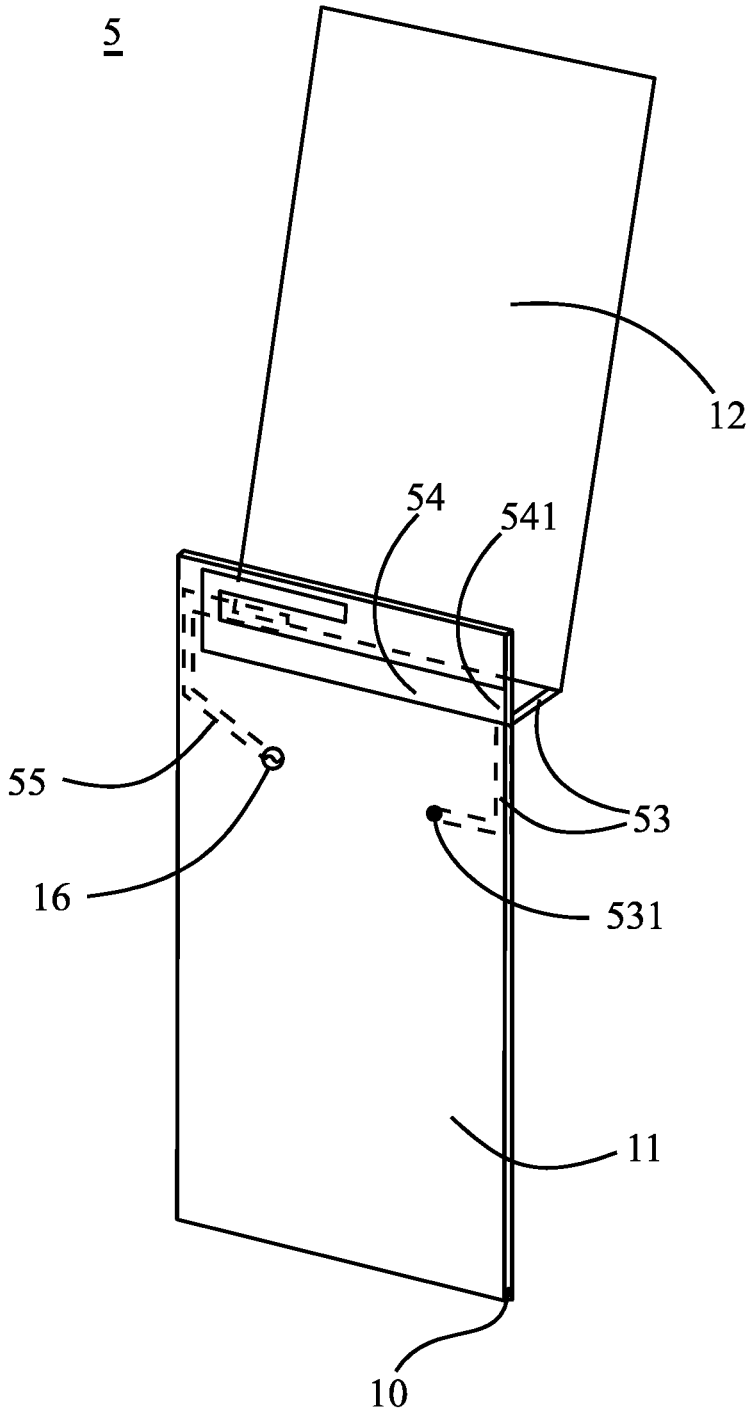
FIG. 5 is a perspective view showing the structure of a monopole slot antenna according to a third embodiment of the present invention.

FIG. 5 is a perspective view showing the structure of a monopole slot antenna 5 according to a third embodiment of the present invention. Tie antenna 5 in the third embodiment in general has a similar structure to the antenna 1 in the first embodiment, except for a metal wire 53 and a monopole slot 54. The metal wire 53 electrically connects the first ground plane 11 to the second ground plane 12 and has a section disposed on one surface of the dielectric substrate 10. The section of the metal wire 53 disposed on the dielectric substrate 10 has a bending and is then short-circuited to the first ground plane 11 via an electric contact 53 1. The monopole slot 54 includes sections having different widths, and is fed by a microstrip feedline 55. The monopole slot 54 has an open end 541 disposed near the metal wire 53 that connects the first and the second ground planes 11, 12. With the above arrangements, the monopole slot antenna 5 in the third embodiment can also achieve the same characteristics of multiband operation as the first embodiment.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A monopole slot antenna, comprising:

a dielectric substrate;

a first ground plane being disposed on a first surface of the dielectric substrate;

a second ground plane being disposed in a vicinity of the first ground plane and electrically connected to the first ground plane via a metal wire, and the metal wire having a section being disposed on a second surface of the dielectric substrate, wherein the second surface is opposite to the first surface;

a monopole slot being disposed only on the first ground plane, and the monopole slot having an open end disposed at an edge of the first ground plane and near the metal wire that connects the first and the second ground planes, and the section of the metal wire is connected to the first ground plane at an electric contact, wherein the electric contact has a distance at least one half of the length of the metal wire to the open end of the monopole slot; and a microstrip feedline being disposed on one surface of the dielectric substrate opposite to the first ground plane, and the microstrip feedline having an end extended across the monopole slot and another end connected to a signal source.

2. The monopole slot antenna as claimed in claim 1, wherein the dielectric substrate is a system circuit board for a mobile communication device.

3. The monopole slot antenna as claimed in claim 1, wherein the first ground plane is a system ground plane for a mobile communication device.

4. The monopole slot antenna as claimed in claim 1, wherein the second ground plane is a backing metal plate for an upper cover of a folder-type communication device.

5. The monopole slot antenna as claimed in claim 1, wherein the first ground plane, the microstrip feedline or the monopole slot is formed on the dielectric substrate through a process selected from the group consisting of printing and etching.

6. The monopole slot antenna as claimed in claim 1, wherein the monopole slot includes at least one bend.

7. The monopole slot antenna as claimed in claim 1, wherein the section of the metal wire disposed on the dielectric substrate includes at least one bend.

8. A monopole slot antenna, comprising:

a dielectric substrate;

a first ground plane being disposed on a first surface of the dielectric substrate;

a second ground plane being disposed in a vicinity of the first ground plane and electrically connected to the first ground plane via a metal wire, and the metal wire having a section being disposed on a second surface of the dielectric substrate, wherein the second surface is opposite to the first surface, and the section having a length at least one half of the length of the metal wire;

a monopole slot being disposed only on the first ground plane, and the monopole slot having an open end disposed at an edge of the first ground plane and near the metal wire that connects the first and the second ground planes, and the section of the metal wire is connected to the first ground plane at an electric contact, wherein the electric contact has a distance at least one half of the length of the metal wire to the open end of the monopole slot; and a microstrip feedline being disposed on one surface of the dielectric substrate opposite to the first ground plane, and the microstrip feedline having an end extended across the monopole slot and another end connected to a signal source.

9. The monopole slot antenna as claimed in claim 8, wherein the dielectric substrate is a system circuit board for a mobile communication device.

10. The monopole slot antenna as claimed in claim 8, wherein the first ground plane is a system ground plane for a mobile communication device.

11. The monopole slot antenna as claimed in claim 8, wherein the second ground plane is a backing metal plate for an upper cover of a folder-type communication device.

12. The monopole slot antenna as claimed in claim 8, wherein the first ground plane, the microstrip feedline or the monopole slot is formed on the dielectric substrate through a process selected from the group consisting of printing and etching.

13. The monopole slot antenna as claimed in claim 8, wherein the monopole slot includes at least one bend.

14. The monopole slot antenna as claimed in claim 8, wherein the section of the metal wire disposed on the dielectric substrate includes at least one bend.

* * * * *